US005842246A

United States Patent [19]

Doyle

[11] Patent Number: 5,842,246

[45] Date of Patent: Dec. 1, 1998

[54] CHIMNEY BRUSHING TOOL

[76] Inventor: Patrick O. Doyle, P.O. Box 642, Kodiak, Ak. 99615-0642

[21] Appl. No.: 803,534

[22] Filed: Feb. 20, 1997

[51] Int. Cl.[6] ..... B08B 9/02; B08B 9/04

[52] U.S. Cl. ..... 15/104.068; 15/104.05; 15/104.16

[58] Field of Search ..... 15/104.05, 104.066, 15/104.067, 104.068, 104.069, 104.16, 104.2, 249.1, 249.2, 249.3

[56] References Cited

U.S. PATENT DOCUMENTS

| | | | |
|---|---|---|---|
| 2,026,680 | 1/1936 | Jacobson | 15/104.068 |
| 2,157,493 | 5/1939 | Miller et al. . | |
| 4,247,964 | 2/1981 | Lichliter et al. . | |
| 4,562,608 | 1/1986 | Weir . | |
| 4,823,425 | 4/1989 | Drobot | 15/104.066 |
| 4,873,739 | 10/1989 | Bardini | 15/104.068 |
| 4,891,115 | 1/1990 | Shishkin et al. | 15/104.05 |

FOREIGN PATENT DOCUMENTS

| | | | |
|---|---|---|---|
| 1191196 | 10/1959 | France | 15/104.067 |
| 170122 | 4/1906 | Germany | 15/104.067 |

*Primary Examiner*—Terrence Till
*Attorney, Agent, or Firm*—Terrance L. Siemens

[57] ABSTRACT

A cleaning brush for scraping the interior of circular chimney flues and stove pipes. The brush has a central threaded rod from which blades radially project in a spiralled arrangement. The blades are just greater in length than the radius of the flue or stove pipe, and connect to the central rod by passing the rod through any one of a series of holes formed in the blade. The blades are adjusted for wear by passing the rod through a different hole. The blades are clamped into the spiral arrangement by being sandwiched between upper and lower washers secured by nuts to the rod. Each blade comprises two U-shaped thin metal members, which may be slats from a venetian blind, adhered back to back. The brush has a dust shield disposed beneath the blade assembly for suppressing passage of dust into living spaces. Optionally, the dust shield comprises a receptacle for retaining dislodged soot.

16 Claims, 3 Drawing Sheets

CHIMNEY BRUSHING TOOL

BACKGROUND OF THE INVENTION

1. Field of the Invention

The present invention relates to cleaning tools, and more particularly, to a tool for brushing the interior surfaces of chimneys. The tool comprises a plurality of scraping or brushing blades mounted spirally on a central rod. The blades project from the rod in a manner similar to construction of a spiral staircase.

2. Description of the Prior Art

When wood and similar organic material is burned in a stove, solid products of combustion coat the chimney or exhaust stack. These products are themselves combustible and will ignite under certain conditions. The resultant chimney fire can attain temperatures so high that the chimney, whether formed of metal or masonry, may be severely damaged. In extreme cases, house fires may ensue.

To prevent these occurrences, chimneys are usually cleaned periodically. Equipment for performing this task is somewhat specialized, in that it must both pass through and engage interior surfaces of flues and chimney pipes. Since flues and chimney pipes are fairly long, typically extending through at least one story of a building, the equipment must be accordingly dimensioned and configured. In general, chimney cleaning equipment has brushes arranged to project radially from a central shaft which is inserted coaxially into the chimney flue or pipe.

An example of a prior art brush is seen in U.S. Pat. No. 4,823,425, issued to Alan J. Drobot on Apr. 25, 1989. Drobot's brush has a plurality of blades projecting radially from a central shaft. However, unlike the present invention, each blade is mounted not directly to the shaft, but on a collar fitted to the central shaft. Also, the blades of Drobot differ from those of the present invention. Drobot's blades are generally flat strips of material bent down at their outer periphery. In the present invention, the blades are shallow, U-shaped channels attached back to back so that the channels open away from one another. In a further departure from Drobot and the prior art generally, individual blades of the present invention are of a length slightly greater than the radius of the brush. By contrast, each blade of Drobot's brush spans the entire diameter of the brush.

A well scraper illustrated in U.S. Pat. No. 2,157,493, issued to Melvin Miller et al. on May 9, 1939, has outwardly projecting scraping blades arranged in such proximity as to occupy the entire circumference of the brush. This arrangement enables cleaning to be performed merely by moving the scraper axially along the well; rotation is not required. However, individual scraping blades in the device of Miller et al. are anchored to the central shaft by entrapment between the shaft and a collar disposed coaxially with the shaft. By contrast, blades in the present invention have holes at their inner ends, allowing them to be placed over the shaft. Miller et al. also lacks the configuration of individual blades wherein each blade comprises two U-shaped channels fastened back to back.

Other chimney brushes are shown in U.S. Pat. No. 4,247,964, issued to William L. Lichliter et al. on Feb. 3, 1981, and 4,562,608, issued to Harvey J. Weir on Jan. 7, 1986. Both of these latter inventions lack the blade structure, blade length, and blade arrangement of the present invention.

None of the above inventions and patents, taken either singly or in combination, is seen to describe the instant invention as claimed.

SUMMARY OF THE INVENTION

The present invention provides a brush for cleaning a round chimney flue or pipe which has a unique type and arrangement of blades. The blades comprise curved or U-shaped thin metal channels fastened back to back. Each blade is of a length slightly greater than the radius of the pipe or flue being cleaned. Each blade has a series of closely spaced apart holes at one end.

A central rod is passed through one of these holes. When a substantial number of blades are thus mounted on the rod, they are fanned or spread out to describe a spiralled ramp configuration. The blades are then clamped into this position. The perforated or proximal ends of the blades are covered by the clamp, and the distal ends extend almost to the interior surface of the flue or pipe. The central rod is then moved axially within the flue or pipe. The distal ends engage the fouled surface of the flue or pipe and dislodge ash, creosote, tar, and other contaminants which have been deposited on the interior surface of the flue or pipe.

Each blade becomes shorter by abrasion with use. When the blades have been worn to the point of ineffectiveness, they are adjusted to a new position wherein effective length is increased so that each blade once more extends almost to the surface of the pipe or flue. This is accomplished by removing the clamp securing blades in their operative position, and reinserting the central shaft through another one of the holes formed in the blades. The blades are again fanned and clamped into position.

A significant benefit of this arrangement is that blades are inexpensively formed from lengths of stock material rather than carefully fabricated into a complicated assembly. A suitable source of U-shaped channels of thin metal is slats from venetian or similar blinds. These slats may be drilled en masse to form holes for mounting, and then are adhered in back to back orientation with a suitable glue. The spiralled arrangement of individual blades both covers the entire circumference or inner surface of the flue or pipe, while still enabling blades of less than diametric length to be utilized.

A great advantage of this arrangement over blades spanning the entire diameter of the brush is that when slightly worn with use, each blade can be adjusted on the central rod and used again. Simple adjustment of outward projection of a blade enables a blade to be fabricated to a slightly excessive length which is still considerably less than the diameter of the flue or pipe. By contrast with the prior art, a blade spanning the full diameter becomes useless if similarly worn.

The double slat construction of the blades causes the entire brush to be quite light, unlike the heavier counterparts utilizing thicker metal straps. Because of the back to back curved orientation of individual slats, a significant degree of resistance to deformation during use is imparted, so that stouter construction is not necessary.

The novel blades improve the art over tools such as that of Lichliter et al., which depends upon rapid rotation for maximum effectiveness. By contrast, the present invention can be wielded by hand, and remains independent from powered rotary tools, electrical power, and the like.

The novel arrangement of the final assembly of individual blades provides almost full coverage of the circumference of the tool, or inner surface of the circular pipe or flue, so that axial motion through the pipe or flue dislodges soot, creosote, and other deposits. Motion can be much slower than that required by rotary power tools, so that less dust is generated.

The novel brush has a disc disposed at the bottom of the central shaft, below the brush elements, for entrapping dust and particles disturbed when cleaning. This barrier assists in preventing excessive permeation of the room housing the stove being cleaned. In an alternative embodiment, it is contemplated that this disc be replaced by a bowl which can retain and retrieve dust and particles. In the latter embodiment, necessary cleaning by vacuum and the like is reduced after brushing the chimney flue or pipe.

Accordingly, it is a principal object of the invention to provide a light, readily wielded cleaning brush for a circular flue or stove pipe.

It is another object of the invention to provide readily fabricated and installed blades for a chimney cleaning brush.

It is a further object of the invention to enable adjustment of outward projection of the blades to compensate for wear.

Still another object of the invention is to minimize weight and complexity of the cleaning brush.

An additional object of the invention is to provide a final brush assembly covering the entire circumference or inner surface of the flue or pipe, while utilizing individual blades of length significantly less than the diameter of the flue or pipe.

It is again an object of the invention to avoid utilizing blades spanning the full diameter of the brush.

Yet another object of the invention is to utilize existing stock material to form individual blades.

Still another object of the invention is to entrap individual blades in place by a single fastener.

A further object of the invention is to provide a dust barrier for preventing excessive permeation of dust into a room containing the stove being cleaned.

A still further object of the invention is to provide a collector for entrapping and retrieving soot and creosote particles dislodged by cleaning.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
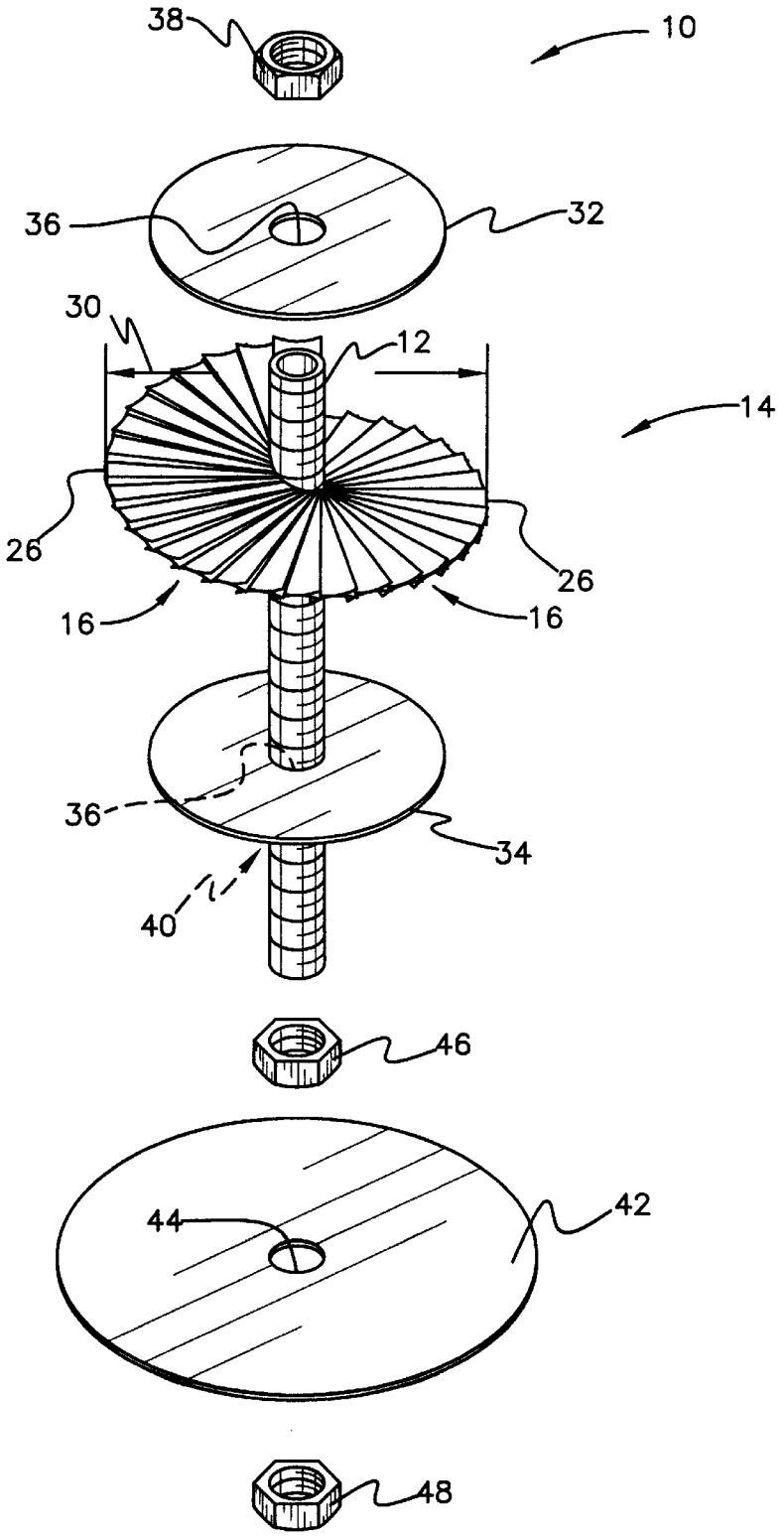
FIG. 1 is an exploded isometric view of the invention.

The essential nature of the invention is shown in FIG. 1. The novel cleaning brush 10 is seen to comprise a threaded central rod 12. A cleaning element 14 comprising a plurality of separate individual blades 16 is mounted on central rod 12 by passage of rod 12 through holes 18 (see FIG. 2) formed in each individual blade 16. Preferably, blades 16 are disposed in an array assuming a configuration of a spiralled ramp about central rod 12.

Figure 2:
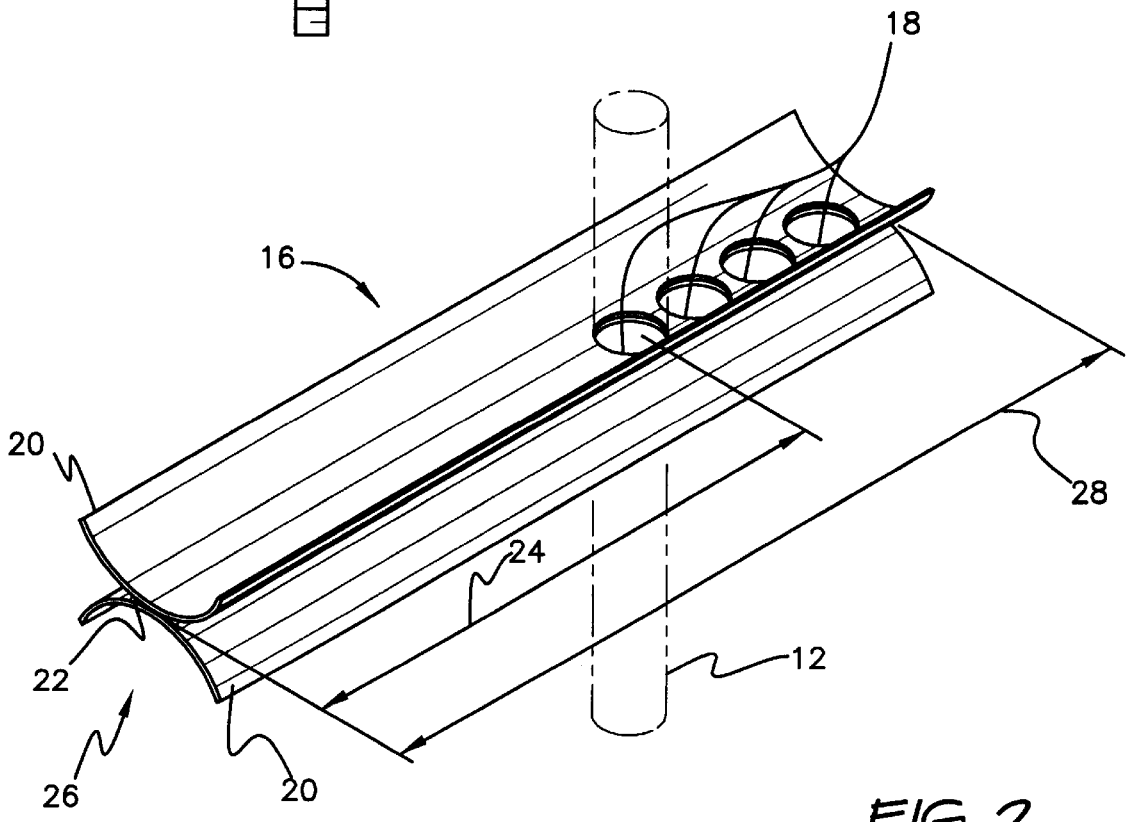
FIG. 2 is a isometric detail view of an individual blade, also illustrating initial installation on the brush.

FIG. 2 illustrates construction of each individual blade 16. Each blade 16 preferably comprises two thin metallic members 20 which are shallow, U-shaped channels fastened to one another in back to back relationship. Fastening may be accomplished in any suitable manner, such as by applying an adhesive 22.

Each blade 16 has a series of holes 18 formed longitudinally therein, for adjusting outward projection of the blade 16 from rod 12. The distance indicated by arrow 24 between a distal end 26 of a blade 16 and the center of the first hole 18 is slightly less than half of an internal circumference or standard nominal size of chimney flues and stove pipes (neither shown). The nominal sizes of chimney flues and stove pipes are standardized throughout the United States at well known diametric dimensions, such as six, seven, eight, and ten inches. For each nominal size, distance indicated at 24 of blade 16 is one eighth to one quarter of an inch less than half of the nominal size, or diameter, of the flue or pipe being cleaned. Obviously, this will result in blades 16 of several different lengths 24 being fabricated to serve all known flues and pipes.

Blades 16 are initially installed on brush 10 with rod 12 passing through the first hole 18, this being the leftmost hole 18 as depicted in FIG. 2. Adjustment of blades 16 to compensate for wear is accomplished by selecting the next hole 18, and mounting all blades 16 to rod 12 at this next hole 18. Subsequent adjustments are possible until the last hole 18 has been utilized to mount its associated blade 16 onto rod 12.

The final overall length 28 will be greater than half of the diameter of the flue or pipe and less than the nominal diameter thereof. This enables a blade 16 to be periodically adjusted in its effective reach. Blades 16 will become shortened by abrasion with use, and the adjustment described above is performed to compensate for wear.

Returning to FIG. 1, cleaning element 14 is seen to have an overall diameter 30 defined between distal ends 26 of any two opposed blades 16. Individual blades 16 extend three hundred sixty degrees about central rod 12, if viewed from either end of rod 12. This characteristic assures that the entire internal circumference of the pipe or flue being cleaned (not shown) is contacted when cleaning by moving cleaning brush 10 axially along the pipe or flue.

Figure 3:
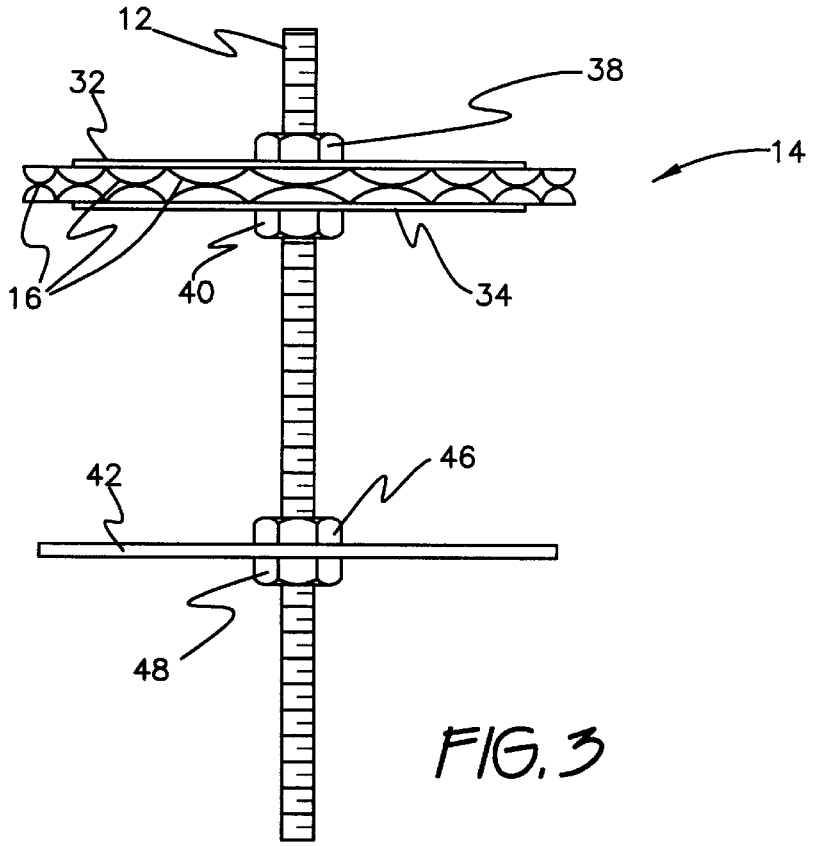
FIG. 3 is a side elevational view of a first alternative embodiment of the invention.

Blades 16 need not be arrayed in a configuration of a spiralled ramp as shown in FIG. 1, although this configuration is considered to be most practical for manual assembly of cleaning brush 10 since it enables immediate discernment of a gap or anomaly (not shown) should one exist and thereby defeat the full circumferential coverage provided by blades 16 as described above. An alternative embodiment, however, is shown in FIG. 3. Regardless of the actual array of blades 16, cleaning element 14 is secured in place on central rod 12 by a clamping arrangement.

Cleaning element 14 is entrapped and compressed between an upper washer 32 and a lower washer 34. Each washer has a hole 36 enabling passage therethrough of rod 12, and an associated upper nut 38 or lower nut 40. Nuts 38 and 40 are threaded onto rod 12 from opposite ends, and are tightened until bearing against washers 32 and 34. Cleaning element is securely entrapped between washers 32 and 34, with blades 16 projecting radially from rod 12.

A disc 42 having an opening 44 is disposed about central rod 12, to act in the capacity of a dust barrier. Dust in the form of loose soot is generated by cleaning flues and pipes, and the dust barrier minimizes the quantity of dust escaping into living spaces containing the flue or pipe being cleaned. Disc 42 is secured in place on rod 12 well below cleaning element 14 by nuts 46 and 48.

FIG. 3 illustrates cleaning brush 10 in its fully assembled condition. A handle (not shown) of any suitable type is provided to grasp cleaning brush 10 from the bottom end of rod 12. Such a handle may comprise a molded member having female threads compatible with the threads formed on rod 12, or may comprise another separate attachable member. Alternatively, the bottom end of rod 12 may be bent into a configuration suitable for manual grasping.

Figure 4:
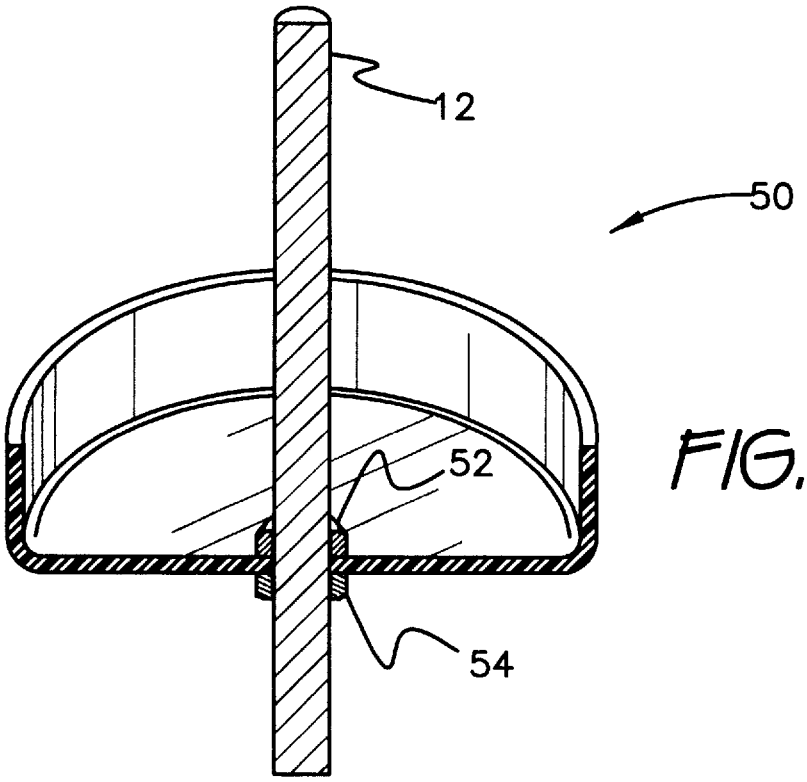
FIG. 4 is a side isometric detail view of another alternative embodiment of the invention.

FIG. 4 illustrates an alternative embodiment wherein a receptacle 50 is mounted to rod 12 by surrounding nuts 52 and 54. Receptacle 50 opens upwardly towards cleaning element 14, in order to collect soot and particles dislodged from the flue or pipe while cleaning. Receptacle 50 may be installed on rod 12 in addition to and above disc 42, or in place of disc 42.

The present invention is susceptible to modifications and variations which may be introduced by those of skill in the art. For example, nuts discussed above may be self-locking nuts, or alternatively, may be plain nuts provided with lock washers. Flat washers may be provided to assist in seating nuts where nuts are shown, it being understood that hardware such as nuts are shown in representative capacity only. It will be expected that conventional sound practice will be applied when actually reproducing the invention.

Similarly, washers 32 and 34, disc 42, and receptacle 50 could be provided with threaded hubs (not shown) or with other structure for mounting to rod 12. Still other variations may be introduced to the invention without departing from the inventive spirit.

It is to be understood that the present invention is not limited to the embodiments described above, but encompasses any and all embodiments within the scope of the following claims.

I claim:

1. A cleaning brush for cleaning soot deposited on the interior surface of a chimney flue or pipe having an internal circumference, said cleaning brush comprising:

a central rod having threads thereon;

a cleaning element having an overall diameter, said cleaning element comprising a plurality of individual blades extending for three hundred sixty degrees about said central rod, whereby the entire internal circumference of the pipe or flue being cleaned is contacted when cleaning by moving said cleaning brush axially along the pipe or flue, each said individual blade having a length less in magnitude than the overall diameter of said cleaning element and greater in magnitude than half of the overall diameter of said cleaning element; and clamping means comprising an upper washer having a first hole for accommodating the passage therethrough of said central rod and an upper nut for threading onto said central rod and for bearing against said upper washer from above; and a lower washer having a second hole for accommodating the passage therethrough of said central rod, and a lower nut for threading onto said central rod and bearing against said lower washer from below, thereby compressing said cleaning element between said upper and said lower washer.

2. The cleaning brush according to claim 1, each one of said individual blades comprising two shallow, U-shaped channels fastened to one another in back to back relationship.

3. The cleaning brush according to claim 1, said individual blades disposed in a configuration of a spiralled ramp about said central rod.

4. The cleaning brush according to claim 1, each said blade having a series of holes formed longitudinally therein, for adjusting outward projection of said blade from said central rod by selectively passing said central rod through one of said series of holes.

5. The cleaning brush according to claim 1, further comprising a dust barrier disposed about said central rod.

6. The cleaning brush according to claim 1, further comprising a dust receptacle disposed about said central rod, said dust receptacle opening towards said cleaning element.

7. A cleaning brush for cleaning soot deposited on the interior surface of a chimney flue or pipe having an internal circumference, said cleaning brush comprising:

a threaded central rod;

a cleaning element having an overall diameter, said cleaning element comprising a plurality of individual blades extending for three hundred sixty degrees about said central rod, whereby the entire internal circumference of the pipe or flue being cleaned is contacted when cleaning by moving said cleaning brush axially along the pipe or flue, each one of said individual blades comprising two shallow, U-shaped channels fastened to one another in back to back relationship, each said blade having a series of holes formed longitudinally therein, for adjusting outward projection of said blade from said central rod by selectively passing said central rod through one of said series of holes, and each said individual blade having a length less in magnitude than the overall diameter of said cleaning element and greater in magnitude than half of the overall diameter of said cleaning element; and clamping means securing said individual blades about said central rod in radially projecting relationship thereto, said clamping means comprising an upper washer having a hole for accommodating passage therethrough of said central rod and an upper nut for threading onto said central rod and bearing against said upper washer from above, and a lower washer having a second hole for accommodating passage therethrough of said central rod, and a lower nut for threading onto said central rod and bearing against said lower washer from below, thereby compressing said cleaning element between said upper washer and said lower washer.

8. The cleaning brush according to claim 7, said individual blades disposed in a configuration of a spiralled ramp about said central rod.

9. The cleaning brush according to claim 7, further comprising a dust barrier disposed about said central rod.

10. The cleaning brush according to claim 7, further comprising a dust receptacle disposed about said central rod, said dust receptacle opening towards said cleaning element.

11. A cleaning brush for cleaning soot deposited on the interior surface of a chimney flue or pipe having a predetermined inner diameter, said cleaning brush comprising:

a central rod;

a cleaning element having an overall diameter, said cleaning element comprising a plurality of individual blades, each one of said individual blades comprising two shallow, U-shaped channels fastened to one another in back to back relationship; and clamping means securing said individual blades about said central rod in radially projecting relationship thereto.

12. The cleaning brush according to claim 11, said central rod having threads disposed thereon, and said clamping means comprising an upper washer having a hole for accommodating passage therethrough of said central rod and an upper nut for threading onto said central rod and bearing against said upper washer from above, and a lower washer having a second hole for accommodating passage therethrough of said central rod, and a lower nut for threading onto said central rod and bearing against said lower washer from below, thereby compressing said cleaning element between said upper washer and said lower washer.

13. The cleaning brush according to claim 11, each said individual blade having a length of magnitude less than that of the overall diameter of said cleaning element and greater in magnitude than half of the overall diameter of said cleaning element.

14. The cleaning brush according to claim 13, each said blade having a series of holes formed longitudinally therein, for adjusting outward projection of said blade from said central rod by selectively passing said central rod through one of said series of holes.

15. The cleaning brush according to claim 11, further comprising a dust barrier disposed about said central rod.

16. The cleaning brush according to claim 11, further comprising a dust receptacle disposed about said central rod, said dust receptacle opening towards said cleaning element.

* * * * *